US005977854A

United States Patent [19]

Mihara et al.

[11] Patent Number: 5,977,854

[45] **Date of Patent: *Nov. 2, 1999**

[54] ELECTROMAGNETIC NOISE ABSORBER

[75] Inventors: Hideyuki Mihara, Shiga-ken; Satoshi Murata, Yokaichi; Yukio Sakamoto, Moriyama, all of Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/896,472

[22] Filed: Jul. 18, 1997

[30] Foreign Application Priority Data

Jul. 19, 1996 [JP] Japan ..... 8-190631

[51] Int. Cl.[6] ..... H01F 17/06; H01F 27/02; H01F 27/26

[52] U.S. Cl. ..... 336/92; 333/12; 336/83; 336/176; 336/212

[58] Field of Search ..... 336/83, 175, 176, 336/212, 92, 90; 333/12, 185; 324/127

[56] References Cited

U.S. PATENT DOCUMENTS

| | | | |
|---|---|---|---|
| 3,262,079 | 7/1966 | Glover et al. | 336/83 |
| 3,423,709 | 1/1969 | Lugten | 336/83 |
| 3,467,930 | 9/1969 | Glover | 336/83 |
| 3,609,615 | 9/1971 | Parker | 336/83 |
| 4,167,719 | 9/1979 | Forge | 336/83 |

*Primary Examiner*—Thomas J. Kozma
*Attorney, Agent, or Firm*—Ostrolenk, Faber, Gerb & Soffen, LLP

[57] ABSTRACT

An electromagnetic noise absorber has a pair of ferrite cores arranged with open ends of the ferrite cores facing each other. Each of the ferrite cores includes an axial portion, an outer cylindrical portion and a bottom portion and is constructed by coupling an end of the axial portion and an end of the outer cylindrical portion to the bottom portion. A slot is formed in the outer cylindrical portion and the bottom portion of each ferrite core such that the slot extends from the open end of the outer cylindrical portion to the bottom portion. The electromagnetic noise absorber can be easily attached to a signal line by placing the signal line in the slots and turning one of the ferrite cores. Since the signal line are wound around the axial portion of the ferrite cores, the signal line has a high impedance.

4 Claims, 5 Drawing Sheets

ELECTROMAGNETIC NOISE ABSORBER

BACKGROUND OF THE INVENTION

1. Field of the Invention

The present invention relates to a noise absorber which prevents electromagnetic noise from being radiated from or entering a signal line between electronic devices, for example, between a computer and its terminal devices.

2. Description of the Related Art

Electromagnetic signals transmitted through a signal line can radiate from the signal line and enter into another signal line. Electromagnetic signals that enter from one signal line into another signal line are usually harmful because such electromagnetic signals cause electromagnetic noise which interferes with the original signals intended to be transmitted through the other signal line.

Conventionally, many type of electromagnetic noise absorbers have been proposed. As shown in FIG. 8, a conventional electromagnetic noise absorber 1 comprises a cylindrical ferrite in which a through hole 2 is provided. The electromagnetic absorber 1 is attached to a signal line 3 with the signal line 3 inserted into the through hole 2 of the electromagnetic noise absorber 1. The signal line 3 can be inserted in the through hole 2 twice so as to form a loop 3*a*, as shown in FIG. 9. This increases the impedance of the signal line 3, thereby reducing electromagnetic noise.

The electromagnetic noise absorber 1, however, has the following drawbacks. Specifically, it is impossible to insert a signal line into the through hole of the electromagnetic absorber 1 if the signal line has connectors larger than the diameter of the through hole 2. The electromagnetic noise absorber 1 is also inconvenient if the signal line 3 is considerably long. Moreover, if the loop 3*a* is formed, as shown in FIG. 9, the signal line 3 may be easily damaged at the bent portions of the loop 3*a*.

In order to provide an electromagnetic noise absorber which can be attached to a signal line having terminal connectors, there has been proposed an electromagnetic noise absorber 5 shown in FIG. 10. The electromagnetic noise absorber 5 comprises a pair of hemi-cylindrical ferrites 6 and 7 and a case 8. The hemi-cylindrical ferrites 6 and 7 are formed by cutting the cylindrical ferrite 1 of FIG. 8 into two pieces along the central axis so that the signal line 3 can easily be placed in the through hole 2 of the cylindrical ferrite 1. The case 8 consists of a pair of containers which are made of an insulating material and are connected to each other at the bending portion 8*a*. Each of the containers holds one of the hemi-cylindrical ferrites 6, respectively. A protrusion 8*b* and a hook 8*c* are provided for locking the containers of the case 8.

When the electromagnetic noise absorber 5 is attached to a signal line (not shown in FIG. 10), the signal line is placed in one of two divided grooves 2*a* and 2*b* which together constitute the through hole 2 and the case 8 is folded such that the hemi-cylindrical ferrites 6 and 7 form a cylindrical shape. The protrusion 8*b* is then fixed to the hook 8*c*, whereby the signal line is held in the through hole 2.

Although the electromagnetic noise absorber 5 may solve the problem associated with attaching the electromagnetic absorber 5 to a signal line with terminal connectors, the electromagnetic noise absorber 5 has a different problem in that it is difficult to provide the signal line with a high impedance.

For the foregoing reasons, there is a need for an electromagnetic noise absorber which is easily attached to a signal line and provides a signal line with a high impedance.

SUMMARY OF THE INVENTION

The present invention provides an electromagnetic noise absorber that satisfies this need. The electromagnetic noise absorber comprises a first ferrite core and a second ferrite core, each of the first and second ferrite cores including an axial portion, an outer cylindrical portion and a bottom portion. A first end of the axial portion and a first end of the outer cylindrical portion is connected to the bottom portion so as to provide a cylindrical space between the outer cylindrical portion and the axial portion and to provide a open second end of the outer cylindrical portion. A first slot is formed in the outer cylindrical portion and the bottom portion such that the first slot extends from the open second end of the outer cylindrical portion to the bottom portion. The first and second ferrite cores are engageable such that both of the open second ends of the first and second ferrite cores face each other.

With the electromagnetic noise absorber of the disclosed embodiments of the invention, a signal line can be easily attached to the electromagnetic noise absorber by placing the signal line in slots of the electromagnetic noise absorber and turning one of the first and second ferrite cores. Therefore, the electromagnetic noise absorber can be suitably applied to a signal line having connectors at the ends thereof or having a great length. Moreover, since the signal line is made to coil around the axial portions of the ferrite cores, the signal line has a high impedance which may be varied in accordance with how many times the signal line is wound.

These and other features, aspects, and advantages of the present invention will become better understood with reference to the following description is and appended claims.

DETAILED DESCRIPTION OF EMBODIMENTS OF THE INVENTION

Hereinafter, several embodiments of the present invention are explained in detail with reference to the drawings.

Figure 1:
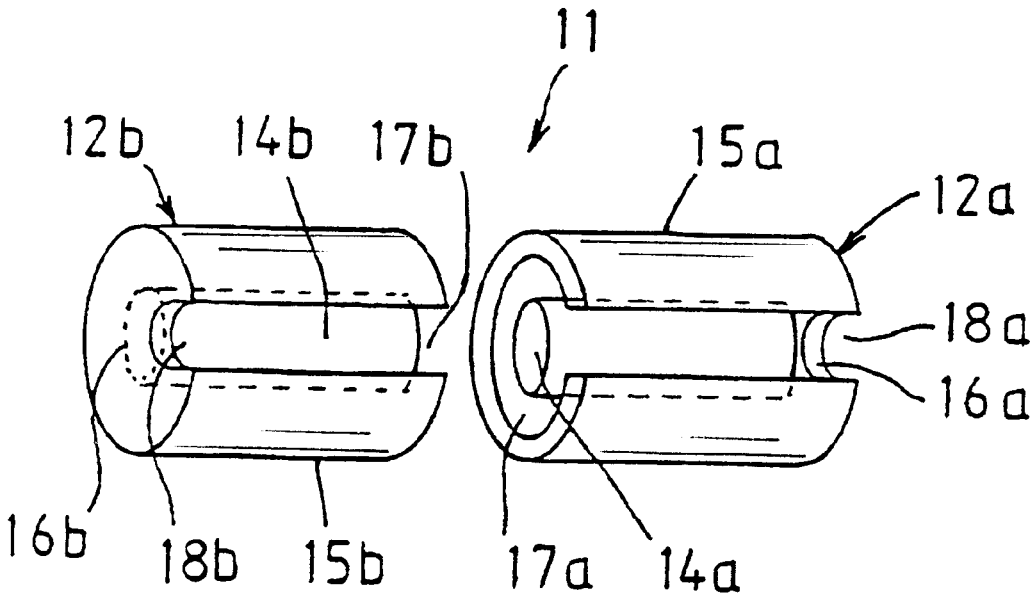
FIG. 1 is an exploded perspective view of an electromagnetic noise absorber according to a first embodiment of the present invention.

FIG. 1 shows an electromagnetic noise absorber 11 according to a first embodiment of the present invention. As shown in FIG. 1, a electromagnetic noise absorber 11 includes a first ferrite core 12*a* and a second ferrite core 12*b*. The first and second ferrite cores 12*a* and 12*b* are made of Ni-Zn ferrite, Ni-Cu-Zn ferrite, Mg-Zn ferrite, or the like.

The first ferrite core 12*a* has an axial portion 14*a*, an outer cylindrical portion 15*a* and a circular bottom portion 16*a*. The axial portion 14*a* has a stick shape and a circular cross section, and the outer cylindrical portion 15*a* has a cylindrical shape and a ringlike cross-section. The bottom portion 16*a* is coupled to one end of the outer cylindrical portion 15*a* and one end of the axial portion 14*a* such that the cylindrical portion 15*a* and the axial portion 14*a* are coaxially aligned. As a result, a cylindrical space 17*a* having a ringlike cross-section is formed between the cylindrical portion 15*a* and the axial portion 14*a*. The cylindrical space 17*a* is open at the other end of the outer cylindrical portion 15*a*. The distance between the cylindrical portion 15*a* and the axial portion 14*a* is enough large to contain a signal line to which the electromagnetic noise absorber 11 is to be attached.

The first ferrite core 12*a* has a slot 18*a* formed in the cylindrical portion 15*a* and in the bottom portion 16*a*. The slot 18*a* extends along the axial direction of the cylindrical portion 15*a* and reaches the open end of the cylindrical portion 15*a*. The other end of the slot 18*a* extends to the periphery of the bottom portion 16*a* where the bottom portion 16*a* is coupled to the cylindrical portion 15*a* and further extends inwardly from the circumference of the bottom portion 16*a*. The width of the slot 18*a* along the circumferential direction of the cylindrical portion 15*a* is sufficiently large that the signal line can be inserted in the slot 18*a*.

The second ferrite core 12*b* has an axial portion 14*b*, an outer cylindrical portion 15*b* and a circular bottom portion 16*b* and is constructed in the same manner as the first ferrite core 12*a*. A cylindrical space 17*b* is also formed between the cylindrical portion 15*b* and the axial portion 14*b*, and a slot 18*b* is formed in the second ferrite core 12*b* in the same manner as the first ferrite core 12*a*. The first and second ferrite cores 12*a* and 12*b* may be formed using the same mold in the same shape.

To assemble the electromagnetic noise absorber 11, the open end of the first ferrite core 12*a* and the open end of the second ferrite core 12*b* are placed so as to face each other, so that the cylindrical space 17*a* is combined with the cylindrical space 17*b* to form a continuous cylindrical space.

Figure 2:
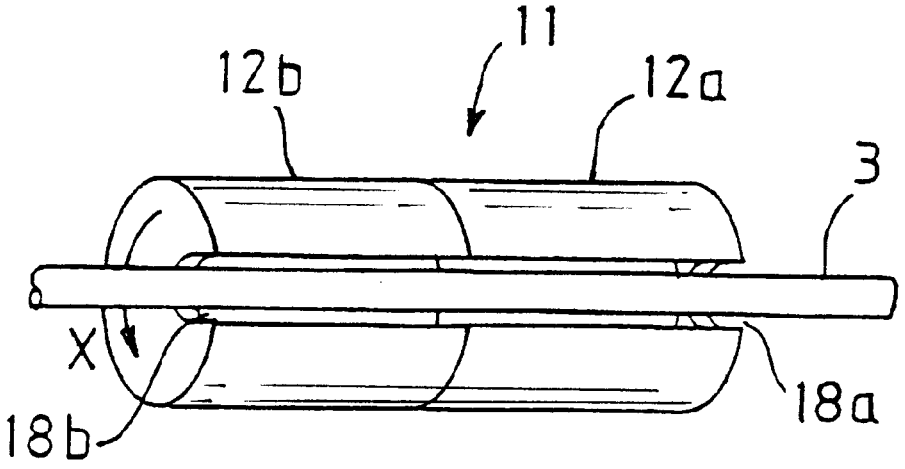
FIG. 2 is a perspective view explaining how the electromagnetic noise absorber shown in FIG. 1 is attached to a signal line.
Figure 3:
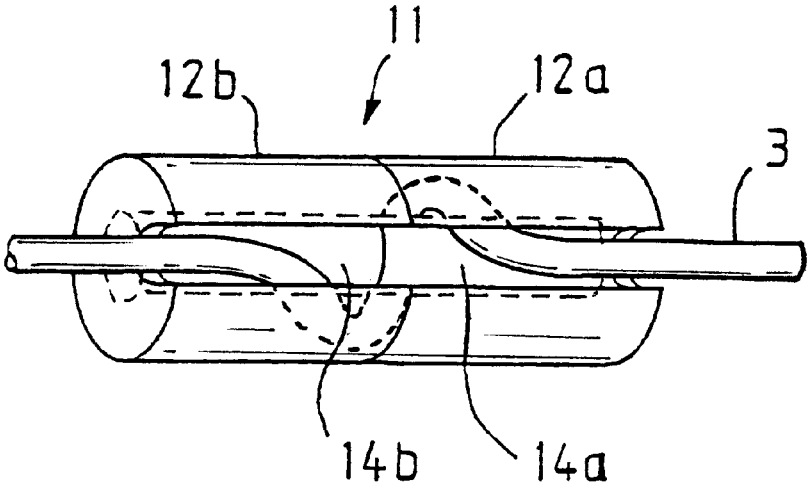
FIG. 3 is a perspective view showing the electromagnetic noise absorber attached to a signal line.

As shown in FIG. 2, to attach the electromagnetic noise absorber 11 to a signal line 3, the first ferrite core 12*a* and the second ferrite core 12*b* are arranged such that the silt 18*a* and the slot 18*b* are aligned. After the signal line 3 is placed in the slots 18*a* and 18*b*, the first ferrite core 12*a* or the second ferrite core 12*b* is rotated around its axis while the second ferrite core 12*b* or the first ferrite core 12*a* is fixed. For example, the second ferrite core 12*b* may be rotated in the direction X while the first ferrite core 12*a* is fixed. The signal line 3 is thus wound around the axial portions 14*a* and 14*b* in accordance with the rotation of the second ferrite core 12*b*. As shown in FIG. 3, when the first ferrite core 12*b* is turned once with respect to the first ferrite core 12*a*, the signal line 3 is wound within the cylindrical spaces 17*a* and 17*b* around the axial portions 14*a* and 14*b*. That is, the signal line 3 is wound once within the electromagnetic noise absorber 11. The signal line 3 can be wound more than once so that the signal line 3 will have a larger impedance. After the signal line 3 is wound, the first and second ferrite cores 12*a* and 12*b* are fixed using an adhesive, an adhesive tape, or the like (not shown).

Figure 8:
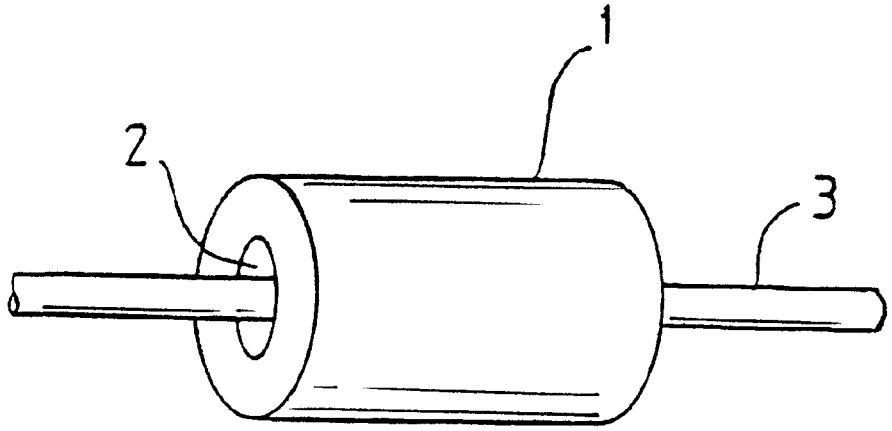
FIG. 8 PRIOR ART
FIG. 8 is a perspective view of a conventional electromagnetic noise absorber through which a signal line is inserted once.
Figure 9:
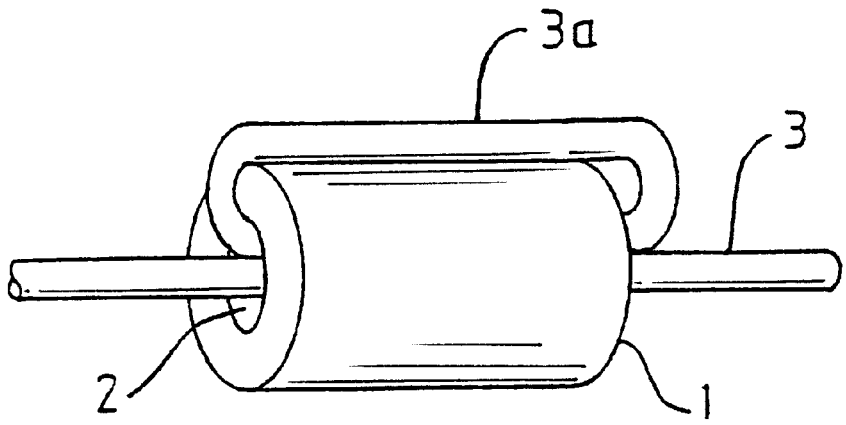
FIG. 9 PRIOR ART
FIG. 9 is a perspective view of the conventional electromagnetic noise absorber through which a signal line is inserted twice.
Figure 10:
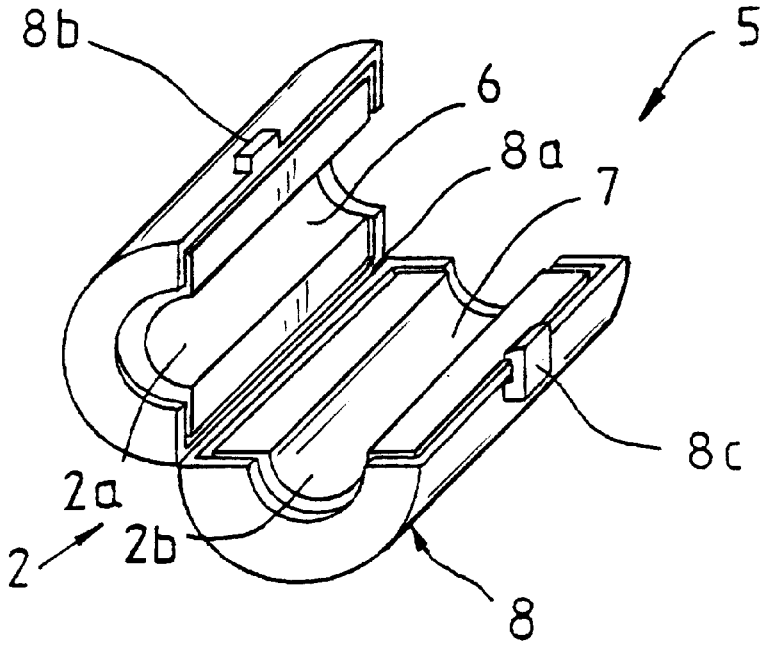
FIG. 10 PRIOR ART
FIG. 10 is a perspective view of another conventional electromagnetic noise absorber.

The foregoing embodiment of the invention was tested as follows. As an example, the electromagnetic noise absorber 11 is produced using a Ni-Zn ferrite material. Each of the first and second ferrite cores 12*a* and 12*b* has a permeability of about 500 and a longitudinal length of 17 mm. The outer cylindrical portions 12*a* and 12*b* have an inner diameter of 14 mm and an outer diameter of 19 mm. The axial portion has an outer diameter of 8 mm. The electromagnetic noise absorber 11 is then attached to a signal line with the signal line wound once around the axial portion. As a comparative example, a conventional electromagnetic noise absorber 1 shown in FIG. 8 is also produced. The electromagnetic noise absorber 1 has a permeability of about 500, a longitudinal length of 17 mm, an inner diameter of 10 mm and an outer diameter of 19 mm. A signal line is then inserted into a through hole of the electromagnetic noise absorber 1. As a result of an impedance measurement, it was found that the signal line attached to the electromagnetic noise absorber 11 according to the embodiment had 1.6 times the impedance of the signal line attached to the conventional electromagnetic noise absorber 1.

According to the electromagnetic noise absorber of the above embodiment of the invention, the signal line 3 can be easily inserted into the electromagnetic noise absorber 11 by placing the signal line 3 in the slots 18*a* and 18*b* of the electromagnetic noise absorber 11 and turning one or both of the ferrite cores 12*a* or 12*b*. Therefore, the electromagnetic noise absorber 11 can be suitably applied to a signal line having connectors at the ends thereof or having a great length. Moreover, since the signal line is coiled around the axial portions 14*a* and 14*b* of the ferrite cores 12*a* and 12*b*, this structure provides the signal line 3 with a high impedance even when the electromagnetic noise absorber 11 is small, and enables the impedance to be varied in accordance with how many times the signal line 3 is wound.

The electromagnetic noise absorber 11 explained above may be modified in various ways. For example, the electromagnetic noise absorber 11 may be constructed so that the pair of ferrite cores may be rotated more easily, by providing one of the pair of ferrite cores with a sleeve.

Figure 4:
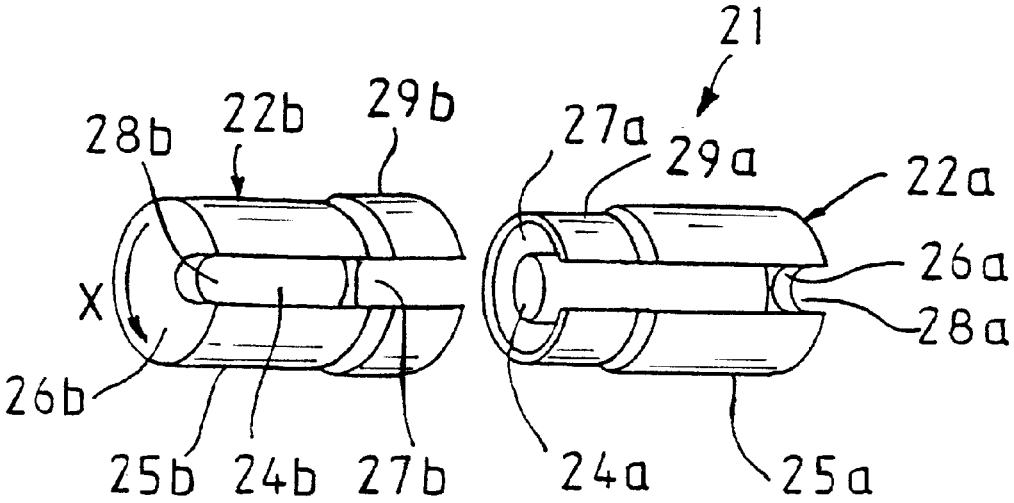
FIG. 4 is an exploded perspective view of an electromagnetic noise absorber according to a second embodiment of the present invention.

As shown in FIG. 4, an electromagnetic noise absorber 21 has a first ferrite core 22*a* and a second ferrite core 22*b*. The first ferrite core 22*a* has an axial portion 24*a*, an outer cylindrical portion 25*a* and a circular bottom portion 26*a* and is constructed in the same manner as the first ferrite core 12*a* of FIG. 1 except that a narrow end 29*a* is formed at an open end of the outer cylindrical portion 25*a*. The outer diameter of the outer cylindrical portion 25*a* at the narrow end 29*a* is smaller than the remaining portion of the outer cylindrical portion 25*a*. A cylindrical space 27*a* is formed between the cylindrical portion 25*a* and the axial portion 24*a*, and a slot 28*a* is formed in the outer cylindrical portion 25*a* and the bottom portion 26*a* in the same manner as in the first ferrite core 12*a*.

The second ferrite core 22*b* has also an axial portion 24*b*, an outer cylindrical portion 25*b* and a circular bottom portion 26*b* and is constructed in the same manner as the second ferrite core 12*b* of FIG. 1 except that a sleeve 29*b* is formed at an open end of the outer cylindrical portion 25*b*. The sleeve 25*b* has an inner diameter which is adapted to engage the narrow end 29*a* of the first ferrite core 22*a*. A cylindrical space 27*b* is also formed between the cylindrical portion 25*b* and the axial portion 24*b*, and a slot 28*b* is formed in the second ferrite core 22*b* in the same manner as in the first ferrite core 22*a*.

To assemble the electromagnetic noise absorber 21, the narrow end 29*a* of the first ferrite core 22*a* is inserted in the sleeve 29*b* of the second ferrite core 22*b*, and in that position the first ferrite core 22*a* and the second ferrite core 22*b* are coaxially rotatable. The cylindrical space 27*a* and the cylindrical portion 27*b* form a continuous cylindrical space and the tips of the axial portion 24*a* and 24*b* touch each other, thereby forming a continuous axis.

According to the aforementioned structure, a coupling structure including the sleeve 29*b* and the narrow end 29*a* secures a coaxial rotation of the ferrite cores 22*a* and 22*b*. Therefore, the ferrite cores 22*a* and 22*b* can be easily rotated without misaligning the axes of the ferrite cores 22*a* and 22*b*, and a signal line can be wound in the electromagnetic noise absorber 21 easily.

Figure 5:
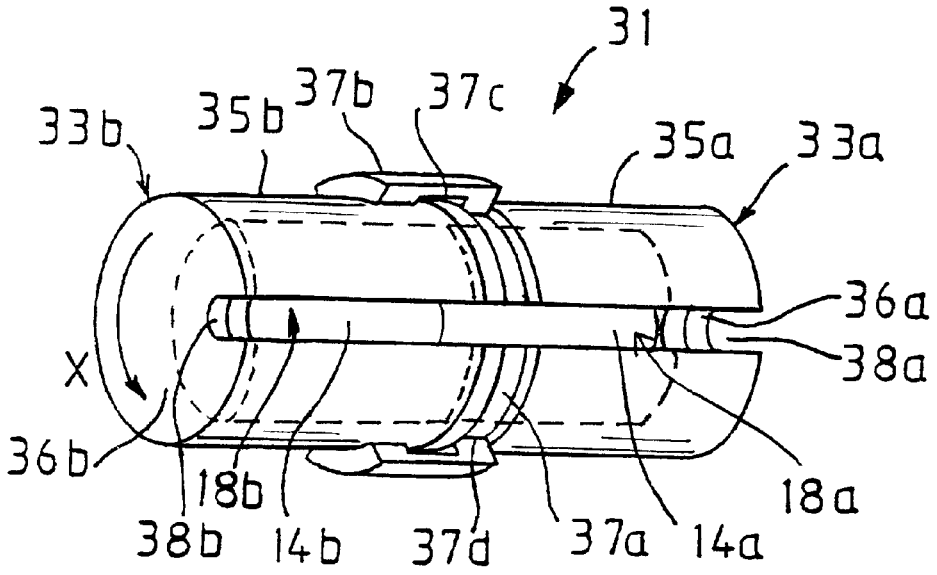
FIG. 5 is a perspective view of an electromagnetic noise absorber according to a third embodiment of the present invention.
Figure 6:
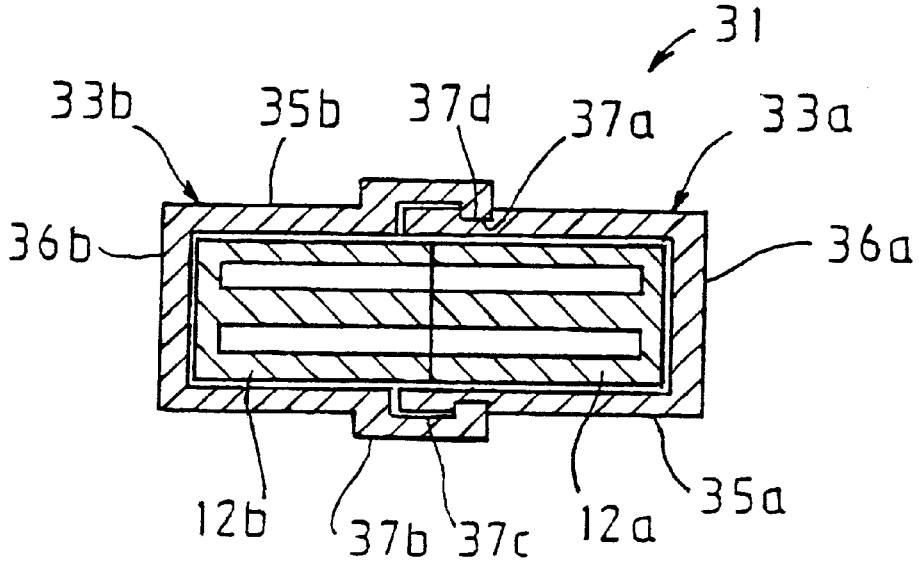
FIG. 6 is a cross-sectional view of the electromagnetic noise absorber shown in FIG. 5.

An electromagnetic noise absorber according to a third embodiment shown in FIGS. 5 and 6 has a pair of cases to contain a pair of ferrite cores. Specifically, an electromagnetic noise absorber 31 has a pair of ferrite cores 12*a* and 12*b* and a pair of cases 33*a* and 33*b*. The ferrite cores 12*a* and 12*b* shown in FIGS. 5 and are identical to the ferrite cores 12*a* and 12*b* shown in FIG. 1. The cases 33*a* and 33*b* are made of an insulating material such as resin.

The case 33*a* has cylindrical portion 35*a* and a bottom portion 36*a*. The bottom portion 36*a* is coupled to one end of the cylindrical portion 35*a* to form an inner space for containing the ferrite core 12*a*. The cylindrical portion 35*a* has a groove 37*a* in the other end thereof such that the groove 37*a* extends along the circumferential direction of the cylindrical portion 35*a*. A slot 38*a* extending in the axial direction is formed in the cylindrical portion 35*a* and the bottom portion 33*a*. The slot 38*a* has a width sufficient to receive a signal line.

The case 33*b* also has a cylindrical portion 35*b* and a bottom portion 36*b*. The bottom portion 36*b* is coupled to one end of the cylindrical portion 35*b* to form an inner space for containing the ferrite core 12*b*. The cylindrical portion 35*b* has two hooks 37*b* at the open end thereof. Although the cylindrical portion 35*b* shown in FIGS. 5 and 6 has two hooks 37*b*, the cylindrical portion 35*b* could have more than two hooks or could have one hook extending along the whole circumference of the cylindrical portion 33*b*. Each of the hooks 37*b* has a recess 37*c* receiving the extremity of the cylindrical portion 35*a* of the case 33*a* and a protrusion 37*d* engaging the groove 37*a* of the cylindrical portion 35*a*. A slot 38*b* extending in the axial direction and having a width sufficient to receive a signal line is formed in the cylindrical portion 35*b* and the bottom portion 33*b*.

In the electromagnetic noise absorber 31, the cases 33*a* and 33*b* retain the ferrite cores 12*a* and 12*b* in the respective inner spaces such that the slot 18*a* of the ferrite core 12*a* and the slot 18*b* of the ferrite core 12*b* are aligned with the slot 38*a* of the case 33*a* and the slot 38*b* of the case 33*b*, respectively. Moreover, a coupling structure provided at the case and including the groove 37*a* of the case 33*a* and the hooks 37*b* of the case 33*b* secures the coaxial rotation of the ferrite cores 12*a* and 12*b* and prevents the ferrite cores 12*a* and 12*b* from separating from each other. Therefore, the ferrite cores 12*a* and 12*b* can be easily rotated without misaligning the axes of the ferrite cores 12*a* and 12*b*, and a signal line can be wound in the electromagnetic noise absorber 31 easily. Furthermore, the cases 33*a* and 33*b* prevent the ferrite cores 12*a* and 12*b* from being destroyed by an impact.

Figure 7:
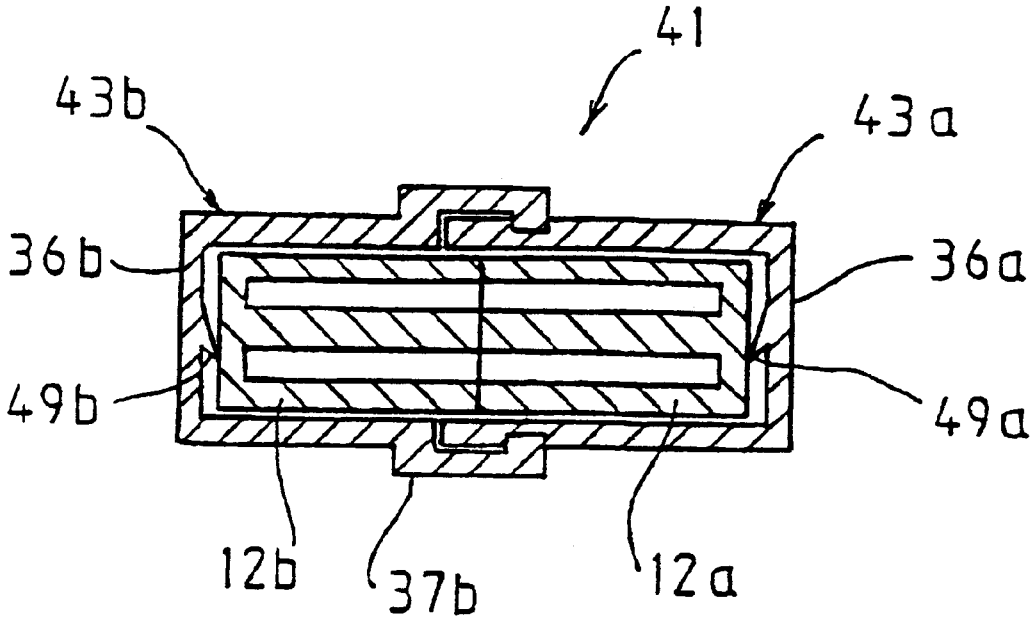
FIG. 7 is a cross-sectional view of an electromagnetic noise absorber according to a fourth embodiment of the present invention.

FIG. 7 shows a fourth embodiment of an electromagnetic noise absorber. The electromagnetic noise absorber 41 has the same structure as the electromagnetic noise absorber 31 shown in FIGS. 5 and 6 except that the cases 43*a* and 43*b* have elastic protrusions 49*a* and 49*b* on the inner sides of their bottom portions 36*a* and 36*b*, respectively. Specifically, the elastic protrusions 49*a* and 49*b* have tips and are integrally formed with the bottom portion 36*a* and 36*b*. It is appreciated that one of the elastic protrusions 49*a* and 49*b* can be omitted and that the elastic protrusions 49*a* and 49*b* may be replaced with a spring or another elastic structure.

In the electromagnetic noise absorber 41, the elastic protrusions 49*a* and 49*b* push the ferrite cores 12*a* and 12*b* such that the ferrite cores 12*a* and 12*b* contact each other tightly. Since this structure prevents a space between the ferrite cores 12*a* and 12*b* from being created, the ferrite cores 12*a* and 12*b* can generate a magnetic field more effectively and provides a signal line with an even higher impedance.

While embodiments of the invention have been disclosed, various other modes of carrying out the principles disclosed herein are contemplated as being within the scope of the following claims. For example, in the ferrite cores 12*a* and 12*b* shown in FIG. 1, the axial portion 13*a* and 13*b* and the outer cylindrical portions 14*a* and 14*b* have a circular cross-section in the direction perpendicular to the axial direction, but the axial portion 13*a* and 13*b* and the outer cylindrical portions 14*a* and 14*b* may have also a polygonal cross section.

Moreover, the axial portions 13*a* and 13*b* of the pair of ferrite cores 14*a* and 14*b* do not have to have the same length as long as the total length of the axial portions 13*a* and 13*b* is the same as that of the outer cylindrical portions 14*a* and 14*b*. The axial portion having the same length as the total length of the outer cylindrical portions 14*a* and 14*b* may be provided on only one of the ferrite cores and no axial portion may be provided on the other of the ferrite cores.

Therefore, it is understood that the scope of the invention is not to be limited by the disclosed embodiments.

What is claimed is:

1. An electromagnetic noise absorber comprising:

a first ferrite core and a second ferrite core, each of the first and second ferrite cores including an axial portion, an outer cylindrical portion and a bottom portion, both a first end of the axial portion and a first end of the outer cylindrical portion being connected to the bottom portion so as to provide a cylindrical space between the outer cylindrical portion and the axial portion and to provide an open second end of the outer cylindrical portion, a respective first slot being formed in each of the first and second ferrite cores in the outer cylindrical portion and the bottom portion such that each first slot extends from the open second end of the outer cylindrical portion to the bottom portion of the corresponding ferrite core, wherein the first and second ferrite cores are engageable with the open second ends of the first and second ferrite cores facing each other, and further comprising first and second cases, each of the first and second cases including a bottom portion, a cylindrical portion connected to the bottom portion at a first end thereof, so as to define a space for containing the first and second ferrite cores, respectively and the cylindrical portion having an open second end, the first and second cases further including a coupling structure provided at the open second ends of the cylindrical portions thereof so that the first and second cases can be rotated coaxially while being coupled together, a second slot being formed in the cylindrical and bottom portions of each of the first and second cases such that the second slot extends from the open end of the cylindrical portion to the bottom portion, wherein the first and second cases can contain the first and second ferrite cores, respectively such that the first slot of the first and second ferrite cores correspond to the second slot of the first and second cases, respectively.

2. An electromagnetic noise absorber according to claim 1, wherein the coupling structure includes a groove provided in the vicinity of the open second end of the first case and a hook provided in the vicinity of the open second end of the second case and the hook has a protrusion for being engaged with the groove.

3. An electromagnetic noise absorber according to claim 1, wherein at least one of the first and second cases has a elastic structure at the bottom portion of the at least one of the first and second cases so as to push the ferrite core contained in the at least one of the first and second cases toward the open second end of the at least one of the first and second cases.

4. An electromagnetic noise absorber according to claim 3, wherein the elastic structure is a protrusion integrally formed with the bottom portion.

* * * * *